United States Patent [19]

Yu

[11] 4,205,816

[45] Jun. 3, 1980

[54] CURTAIN HOLDER

[76] Inventor: Ching-Leei Yu, 144-1, Sec. 1, Chung-San N. Road, Taipei, Taiwan

[21] Appl. No.: 895,508

[22] Filed: Apr. 11, 1978

[51] Int. Cl.[2] ..... A47H 1/10

[52] U.S. Cl. ..... 248/266; 248/207; 160/84 R; 160/250

[58] Field of Search ..... 160/84 R, 250, 263, 160/266; 248/57, 251, 252–266, 207

[56] References Cited

U.S. PATENT DOCUMENTS

| | | | |
|---|---|---|---|
| 1,485,748 | 3/1924 | Wisekal | 248/266 |
| 1,529,671 | 3/1925 | Prue | 248/266 |
| 3,371,700 | 3/1968 | Romano | 248/254 |
| 3,487,875 | 1/1970 | Shukat et al. | 160/84 R |

*Primary Examiner*—Peter M. Caun

*Attorney, Agent, or Firm*—Burns, Doane, Swecker & Mathis

[57] ABSTRACT

The present new invention relates to a "L" shape curtain holder which has a device of adjustable length at both sides, and which can be installed at the upper end of a window of any size with the up-side or the side of the holder. Within the holder there is a roller which can bring the curtain up and down by its attached rope.

4 Claims, 4 Drawing Figures

CURTAIN HOLDER

BACKGROUND AND OBJECTS OF THE INVENTION

The present new invention relates to a curtain holder which has a "L" shape and has an extensible sub-holder in both sides of the main holder, so that it can be installed at the upper end of a window of any size by adjusting the length of the sub-holder. Also because the holder has a "L" shape, it can be installed at the top of window with either its upper leg or a side leg. Within the holder there is a roller which can bring the curtain up and down by its attached rope.

Traditionally when we install the curtain holder at the top of a window, it is necessary to cut the holder for a proper length in order to match the size of the window, and we need some attachments mounted on the holder. Therefore after cutting, the rest of the holder is of no use and must be thrown away. Also these holders can only be installed to the window in a definite fixed direction, so when we want to install it to a different side; we must prepare some other attachments, therefore it is inconvenient to install and use.

It is the purpose of the present new invention to resolve the above said defects of curtain holders and provide a convenient and more useful holder.

BRIEF SUMMARY OF A PREFERRED EMBODIMENT OF THE INVENTION

The holder of the present invention is made of iron plate of "L" shape, having an extensible sub-holder attached to both sides of the main holder, and within the holder there are two earings separately to set a roller between them, and two ropes mounted on the roller which can bring the curtain up and down after setting the holder and curtain.

Because the present new invention has an extensible sub-holder in both sides of the main holder, it can be adjusted in length to correspond to various sizes of window. Especially when using this new holder, we can set variously sized curains. The installation of holder and curtain don't need any other attachments.

The other character of this new curtain holder is that it is in "L" shape which can be installed to the top of the window by means of its side leg or by means of its upper leg according to the form of the window. Therefore this new holder can be used with curtains of cloth, wood bamboo or plastic and will be in good shape regardless of the influences of sunshine or moisture of the air.

THE DRAWING

The new invention will be more really understood from the following description and illustration with drawings.

DETAILED DESCRIPTION OF THE PREFERRED EMBODIMENT

Figure 1:
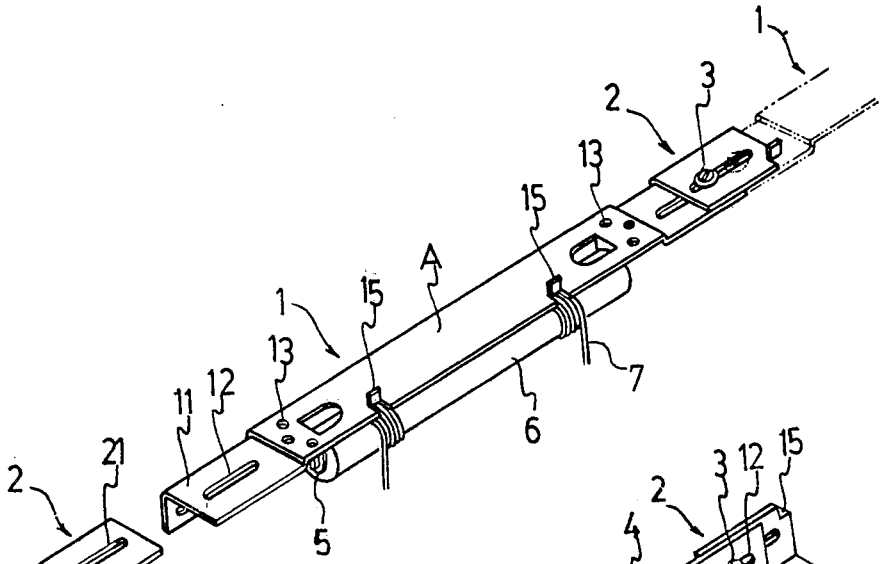
FIG. 1 is a perspective view of curtain holder from the top.
Figure 2:
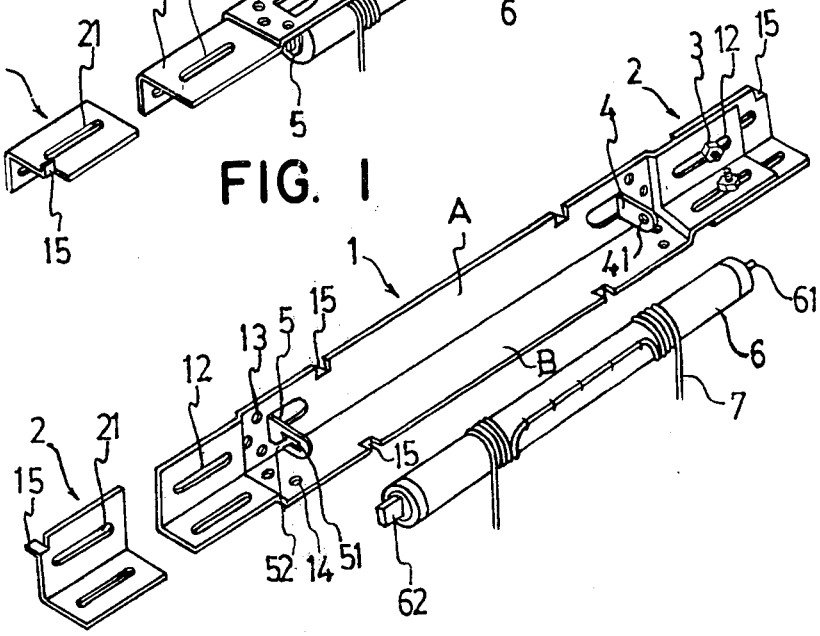
FIG. 2 is a perspective view of said holder from beneath with a roller depicted in exploded form.

The main holder 1 is in a "L" shape. The both ends of both legs A, B of the holder are slightly lower, i.e., stepped inwardly with long holes or slots 12 on one side or both sides. A extensible sub-holder 2 with long holes or slots 21 on them can be set on the outer surface of both legs of the main holder 1 by thread fasteners 3. By means of the sub-holder the length of the holder can be adjusted according to the width of the window and the outer surface sub-holder 2 can be on the same level with outer surface of the main holder 1. More sub-holders can be added in accordance with the width of a large window. There are two brackets or earings 4 & 5 separately inside the main holder; a hole 41 is set on one of earings 4; a long hole or slot 51 is set on the other one 5. The edge of earing 5 has an open part 52, in order to install a roller 6. While in the settlement of holder, different sets of earings can be installed according to the need of length. At one end of the roller, there is an outstanding cylindrical axis 61, and at the other end there is a flat axis 62. There are windding ropes 7 on the roller which can bring the curtain up and down. When setting the roller on the holder, insert the outstanding axis 61 in the earing 41, then insert the flat axis 62 through the open part 52 of the earing 5.

Figure 3:
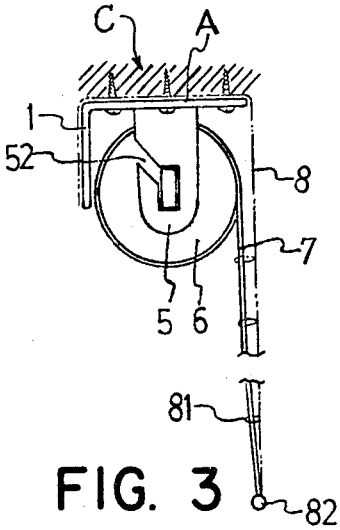
FIG. 3 is a cross sectional view of the holder when it is installed in position by means of the upper side or leg of the holder.
Figure 4:
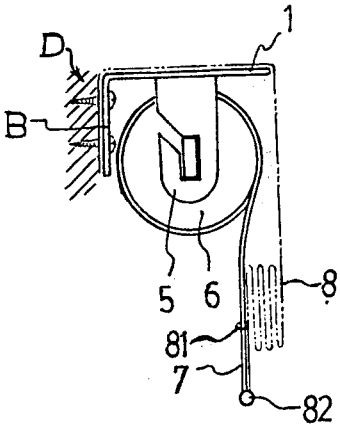
FIG. 4 is a cross sectional view of the holder when it is installed in position by means of the side leg of the holder.

There are holes 13, 14 in both sides of the main holder 1. When fixing the holder at the extreme top C of the window, insert screws through the holes 13 on leg A as shown in FIG. 3. When fixing the holder at the front side D of the window, use with the insert screws through holes 14 on leg B as shown in FIG. 4. There are several bent tabs 15 on the edge of main holder 1 and the sub-holder 2. When we fix the curtain, the curtain 8 should be mounted over the holder. After penetrating the curtain, bend the bent tabs to fix the curtain. The curtain in place 8 is controlled for up and down movement by ropes 7 which are mounted at one end to the roller and at another end to the bottom 83 of the curtain through several rings 81 on the curtain.

Therefore, by means of the present invention the curtain holder can be attached to the underside of the top part C of the window frame, or to the front face of a front side piece D of the window frame. Moreover, the length of the holder can be adjusted to fit window frames of different sizes.

I claim:

1. A curtain holder for securing a curtain on a window frame, comprising a pair of horizontally elongate, integrally connected legs disposed in L-shaped relationship forming an angle therebetween, a first one of said legs being horizontally oriented and a second one of said legs being vertically oriented, a pair of horizontally spaced brackets disposed on one of said legs within said angle formed between said legs, said bracket including recesses for supporting opposite ends of a curtain roller and defining a horizontal rotary axis therefor, each of said legs extending parallel to such axis, each of said legs including apertures extending completely therethrough to enable fasteners to be positioned selectively through said first leg to secure the holder to a horizontal surface at the top of a window frame or through said second leg to secure said holder to a vertical surface at an upper side of the window frame.

2. A curtain holder according to claim 1, wherein both ends of each of said legs are stepped inwardly, and an L-shaped extension is adjustably mounted on at least one said stepped portion in engagement with said legs to enable the length of the holder to be adjusted.

3. A curtain holder according to claim 1, wherein said first leg carries said pair of brackets which depend vertically downwardly therefrom.

4. A curtain holder of the type which is attached at the upper end of a window frame, a roller is rotatably mounted on the holder, a rope is mounted on the roller for rotating the roller about an axis, and a curtain is attached at one end to the holder and at another end to the rope so as to be raised and lowered by raising and lowering the rope, the improvement wherein:

said holder comprises a main body portion and an attachment extensibly and retractably mounted to at least one end of the main body portion to enable the length of the holder to be adjusted to fit window frames of different size, said main body portion including a pair of horizontally elongate, integrally connected legs disposed in L-shaped relationship forming an angle therebetween, a first one of said legs being horizontally oriented and a second one of said legs being vertically oriented, a pair of horizontally spaced brackets depending downwardly from said first leg within said angle formed by said legs and including recesses supporting opposite ends of said roller for rotation about said axis, each of said legs extending parallel to said axis, each of said legs including apertures extending completely therethrough to enable fasteners to be positioned selectively through said first leg to secure the holder to a horizontal surface at the top of a window frame or through said second leg to secure said holder to a vertical surface at an upper side of the window frame;

the outer legs of each of said first and second legs being stepped inwardly;

said attachment being of L-shaped configuration and being slidably mounted on said stepped end portions.

* * * * *